US005388931A

United States Patent [19]

Carlson

[11] Patent Number: 5,388,931

[45] Date of Patent: Feb. 14, 1995

[54] CUTOFF WALL SYSTEM TO ISOLATE CONTAMINATED SOIL

[76] Inventor: Robert J. Carlson, 15 Chestnut Hill Ct., The Woodlands, Tex. 77380

[21] Appl. No.: 137,729

[22] Filed: Oct. 18, 1993

[51] Int. Cl.[6] ..... E02D 5/02; E02D 5/14

[52] U.S. Cl. ..... 405/274; 405/129; 405/281; 403/331

[58] Field of Search ..... 405/128, 129, 255, 267, 405/274, 278, 279, 281; 403/331; 256/66

[56] References Cited

U.S. PATENT DOCUMENTS

| | | | |
|---|---|---|---|
| 3,924,413 | 12/1975 | Marsh | 405/255 X |
| 4,464,081 | 8/1984 | Hillier et al. | 405/128 |
| 4,671,705 | 6/1987 | Nussbaumer et al. | 405/267 |
| 4,877,358 | 10/1989 | Ressi di Cervia | 405/267 |
| 4,909,674 | 3/1990 | Konno et al. | 405/267 |
| 4,927,297 | 5/1990 | Simpson | 405/267 X |
| 4,990,210 | 2/1991 | Glaser et al. | 405/267 X |
| 5,066,353 | 11/1991 | Bourdo | 405/274 X |
| 5,127,771 | 7/1992 | Wind | 405/267 |
| 5,145,287 | 9/1992 | Hooper et al. | 405/274 X |

FOREIGN PATENT DOCUMENTS

| | | | |
|---|---|---|---|
| 111717 | 9/1981 | Japan | 405/278 |
| 11713 | 1/1988 | Japan | 405/267 |
| 8300596 | 9/1984 | Netherlands | 405/281 |

OTHER PUBLICATIONS

Gundle ® Lining Systems Brochure, 1991.
SLT, North America, Inc Brochure.

*Primary Examiner*—Randolph A. Reese
*Assistant Examiner*—John A. Ricci
*Attorney, Agent, or Firm*—E. Vassiliou

[57] ABSTRACT

Methods and structural configurations of modular barrier systems and cutoff walls used to isolate contaminated soils from the environment in situ. The cutoff walls comprise plastic sheets, preferably of high density polyethylene, inserted in or adjacent to dense soil (such as bentonite modified) walls, and they are connected to each other with tubular connectors having flaps to which the plastic sheets are connected, preferably by welding.

47 Claims, 10 Drawing Sheets

FIG. 10b
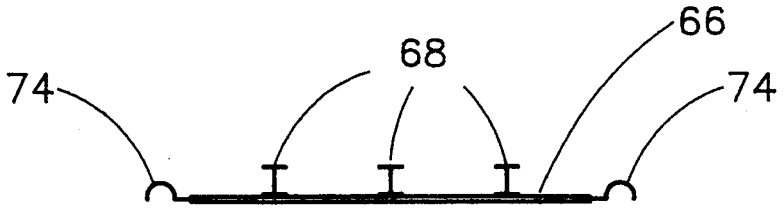
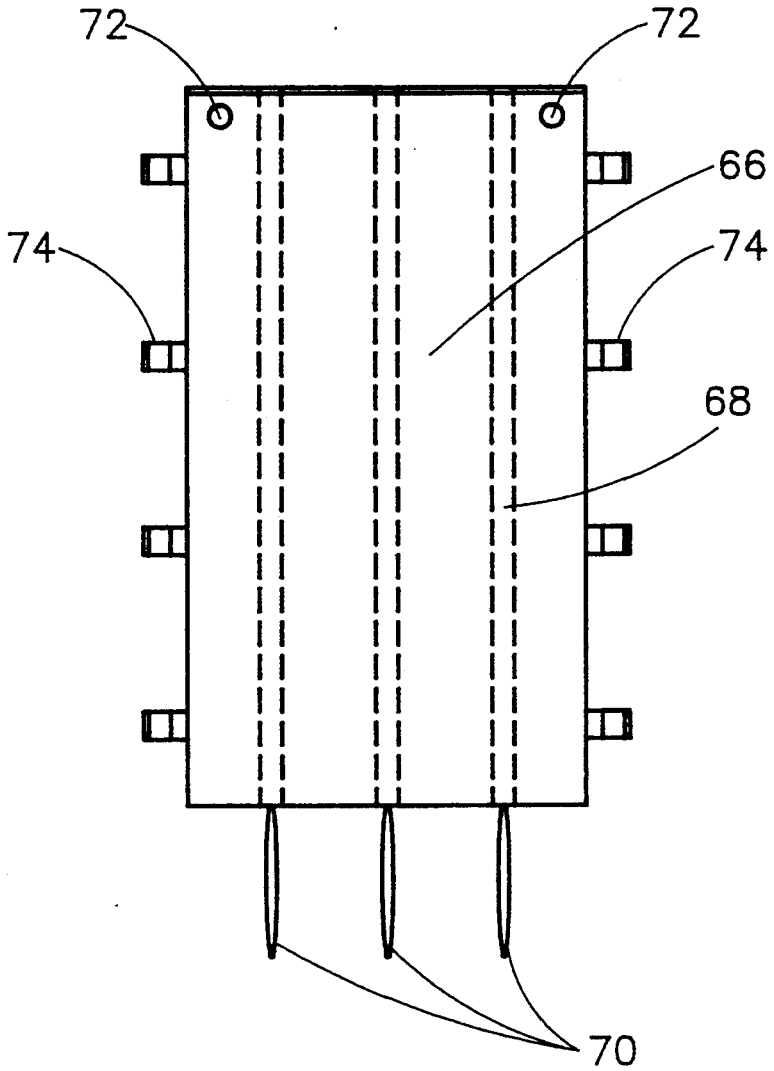
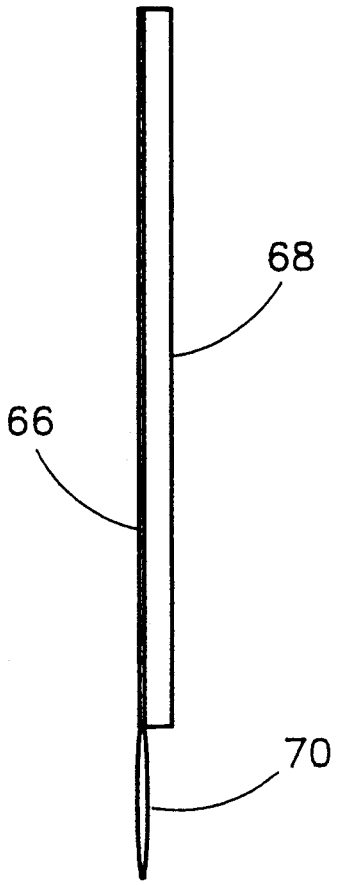
FIG. 10a FIG. 10c

CUTOFF WALL SYSTEM TO ISOLATE CONTAMINATED SOIL

FIELD OF THE INVENTION

This invention relates to modular barrier systems for isolating contaminated soils. More particularly, it relates to modular cutoff walls and methods for isolating contaminated soils in situ from the environment. It also relates to connectors for connecting the individual plastic sheets in the form of modular panels.

BACKGROUND OF THE INVENTION

As society progresses, and production of more and more sophisticated products increases dramatically with time, it is inevitable that more and more unwanted and hazardous by-products are also produced. Although minimization of hazardous waste is the most desirable solution in any industrial process, and a final goal should be complete elimination of hazardous waste by-products, this is a very difficult task, because of both technical and economical reasons.

Therefore a number of different ways have been developed to dispose of the hazardous wastes in a manner as safe as possible.

Incineration is a major technique used presently for this purpose, having a rather broad applicability. However, incineration is a rather expensive process, and although it can be used very effectively for eliminating organic compounds, hazardous inorganic compounds remain behind. The inorganic compounds are bound in a relatively low leachable structure, but they are still considered as hazardous.

Landfills have been used for a very long time to bury hazardous wastes which have been produced by the industry, the community and the government. The remaining inorganic wastes after the incineration, most of the time, are also buried in landfills.

These wastes are characterized by different degrees of hazard, and thus it is becomes important to isolate the landfill in a manner to avoid leaching of hazardous compounds to the environment outside the landfill. However, this need to isolate the landfills from the environment had not been realized at the beginning of the EPA era, and thus, there are still in existence a number of old landfills which may not have adequate isolation from the environment.

In addition, there are different pieces of land which have been contaminated in the past for one reason or another. Decontamination of the soil contained in those pieces of land, in most occasions, is not feasible from an economic point of view.

Therefore there is a strong need for economical and practical ways to isolate pieces of land having contaminated soil, especially if the contamination is rather light.

Gundle Lining Systems of Houston, Texas have available modular High-Density-Polyethylene barrier systems, using a connector comprising one solid male portion with a flap, and a female portion having a groove, a tube slot and a flap. The two portions, after being connected, form a tight contact by means of seal in the form of a strip extending lengthwise in the groove of the female portion.

SLT North America, Inc, also have available modular High-Density-Polyethylene barrier systems, using a connector comprising a multi-cavity female portion and a multi-T-shaped male portion of complicated configuration.

U.S. Pat. No. 4,464,081 discloses a hazardous waste system for safely containing hazardous waste and monitoring any water or leachates that might exist in the system. The system includes several protective layers for surrounding the hazardous waste, a perimeter wall to minimize any horizontal slippage of the hazardous waste, a cap to protect the hazardous waste from the surface environment, and a support base including an impervious top surface above the ground for providing a barrier between the ground and the hazardous waste.

SUMMARY OF THE INVENTION

As aforementioned, this invention relates to isolating modular barrier systems for contaminated soils. More generally, it relates to modular cutoff walls and methods for isolating contaminated soils in situ from the environment. It also relates to connectors for connecting the barrier modules or individual plastic sheets. In more detail, this invention pertains to a connector for plastic sheet comprising an outer portion and an inner portion, the outer portion comprising a first tube having a tube slot lengthwise, and a first flap disposed in a diametrically opposite position with respect to the tube slot and directed away from the tube slot, the first tube also having a first upper end and a first lower end; and the inner portion comprising a second tube having a second flap, the second tube adapted to fit within the first tube in a manner that the second flap extends through the tube slot in a direction away from the first flap, the second tube also having a second upper end and a second lower end.

Further, the instant invention pertains to a secondary barrier comprising a plurality of interconnected panels, each panel comprising a plastic sheet having a first edge and a second edge, each plastic sheet attached to a successive plastic sheet by means of connectors, each connector comprising an outer portion and an inner portion, the outer portion comprising a first tube having a tube slot lengthwise, and a first flap disposed in a diametrically opposite position with respect to the tube slot and directed away from the tube slot, the first tube also having a first upper end and a first lower end; and the inner portion comprising a second tube having a second flap, the second tube adapted to fit within the first tube in a manner that the second flap extends through the tube slot in a direction away from the first flap, the second tube also having a second upper end and a second lower end.

the attachment made so that one of the edges of one plastic sheet is connected to one of said flaps of the connector, and one of the edges of the successive sheet is connected to the remaining flap of the same connector.

In addition, this invention relates to a cutoff wall system comprising a primary barrier and a secondary barrier, the primary barrier being in the form of a dense soil wall the secondary barrier disposed within the primary barrier, the secondary barrier comprising a plurality of interconnected panels, each panel comprising a plastic sheet having a first edge and a second edge, each plastic sheet attached to a successive plastic sheet by means of connectors, each connector comprising an outer portion and an inner portion, the outer portion comprising a first tube having a tube slot lengthwise, and a first flap disposed in a diametrically opposite position with respect to the tube slot and directed away from the tube slot, the first tube also having a first upper end and a first lower end;

the inner portion comprising a second tube having a second flap, the second tube adapted to fit within the first tube in a manner that the second flap extends through the tube slot in a direction away from the first flap, the second tube also having a second upper end and a second lower end;

the attachment made so that one of the edges of one plastic sheet is connected to one of said flaps of the connector, and one of the edges of the successive sheet is connected to the remaining flap of the same connector.

Finally, this invention pertains to a method of forming a cutoff wall comprising the steps of forming a trench filling the trench with dense soil to form a primary barrier;

inserting an initial panel within the primary barrier, the panel comprising a plastic sheet having a first edge and a second edge, and a connector comprising an outer portion and an inner portion the outer portion comprising a first tube having a tube slot lengthwise, and a first flap disposed in a diametrically opposite position with respect to the tube slot and directed away from the tube slot, the first tube also having a first upper end and a first lower end;

the inner portion comprising a second tube having a second flap, the second tube adapted to fit within the first tube in a manner that the second flap extends through the tube slot in a direction away from the first flap, the second tube also having a second upper end and a second lower end;

the attachment of the plastic sheet to the connector made so that the first edge of the plastic sheet is connected to the first flap and the second edge is connected to the second flap of the connector;

inserting a successive panel within the primary barrier, the successive panel being substantially identical to the initial panel, in a manner that the second tube of the successive panel is inserted into the first tube of the initial panel; and inserting more panels within the primary barrier, each panel being interconnected to a successive one in a similar manner until a desired number of interconnected panels have formed a secondary barrier, thus completing the cut-off wall.

It is preferable that the secondary barrier is inserted with the help of a metal plate, to which said secondary barrier is temporarily attached.

It is also preferable that the cutoff system further comprises a hard cover on top of it for substantially eliminating water infiltration toward said cutoff system, and that the primary barrier comprises bentonite.

Preferably, the first edge of each plastic sheet of the secondary barrier is connected to the first flap of one connector and the second edge is connected to the second flap of another connector. It is also within the realm of the present invention the arrangement, wherein both edges of a first set of plastic sheets are connected to the first flap of a set of connectors forming a first set of panels, and both edges of a second set of plastic sheets are connected to the second flap of a second set of connectors forming a second set of panels, the panels interconnected in a manner that panels corresponding to the first set alternate with panels corresponding to the second set.

The connectors and the plastic sheet are preferably made of plastic material, which more preferably is heat sealable or weldable, or both, and even more preferably it comprises High Density Polyethylene.

Further, it is preferable that the first and second flaps of the connectors are integral parts of the respective tubes, and that the outer portion and the inner portion of connectors have been made by an extrusion process.

The connector preferably comprises a sealer substantially surrounding the second tube and disposed between the first tube and the second tube. Also, it is preferable that the first tube further comprises a cap fitted around the first lower end, and/or the second lower end has perforations.

BRIEF DESCRIPTION OF THE DRAWING

The reader's understanding of practical implementation of preferred embodiments of this invention will be enhanced by reference to the following description taken in conjunction with the drawing figures, wherein

FIG. 10*a* shows schematically the front view of a steel plate used to introduce modular panels into the "green" primary barrier.

FIG. 10*b* shows schematically the side view of a steel plate used to introduce modular panels into the "green" primary barrier.

FIG. 10*c* shows schematically the top view of a steel plate used to introduce modular panels into the "green" primary barrier.

DETAILED DESCRIPTION OF THE INVENTION

As aforementioned, this invention relates to modular barrier systems and cutoff walls for isolating contaminated soils from the environment in situ. It also relates to connectors for connecting the barrier modules. These connectors play a vital role to the implementation of the present invention, as it will be realized from the following detailed description of preferred embodiments. The embodiments described hereinwith are cited for illustration purposes only and they should not be construed as restricting the scope of this invention.

According to a preferred embodiment of the present invention, a wall is formed in the ground. The ground is dug to an adequate depth, so that the contaminants, after the final cutoff wall has been formed, will be prevented from escaping. The cutoff wall has a primary barrier of dense soil, preferably comprising bentonite. It also has a secondary barrier comprising modules of plastic sheets, imbedded within the primary barrier, and connected with tubular connectors. Since, as aforementioned, these connectors play a very important role to the practice of this invention, their structural characteristics and operation will be described first, so that the reader will gain a better understanding of the total cutoff wall system as the description progresses.

Figure 1:
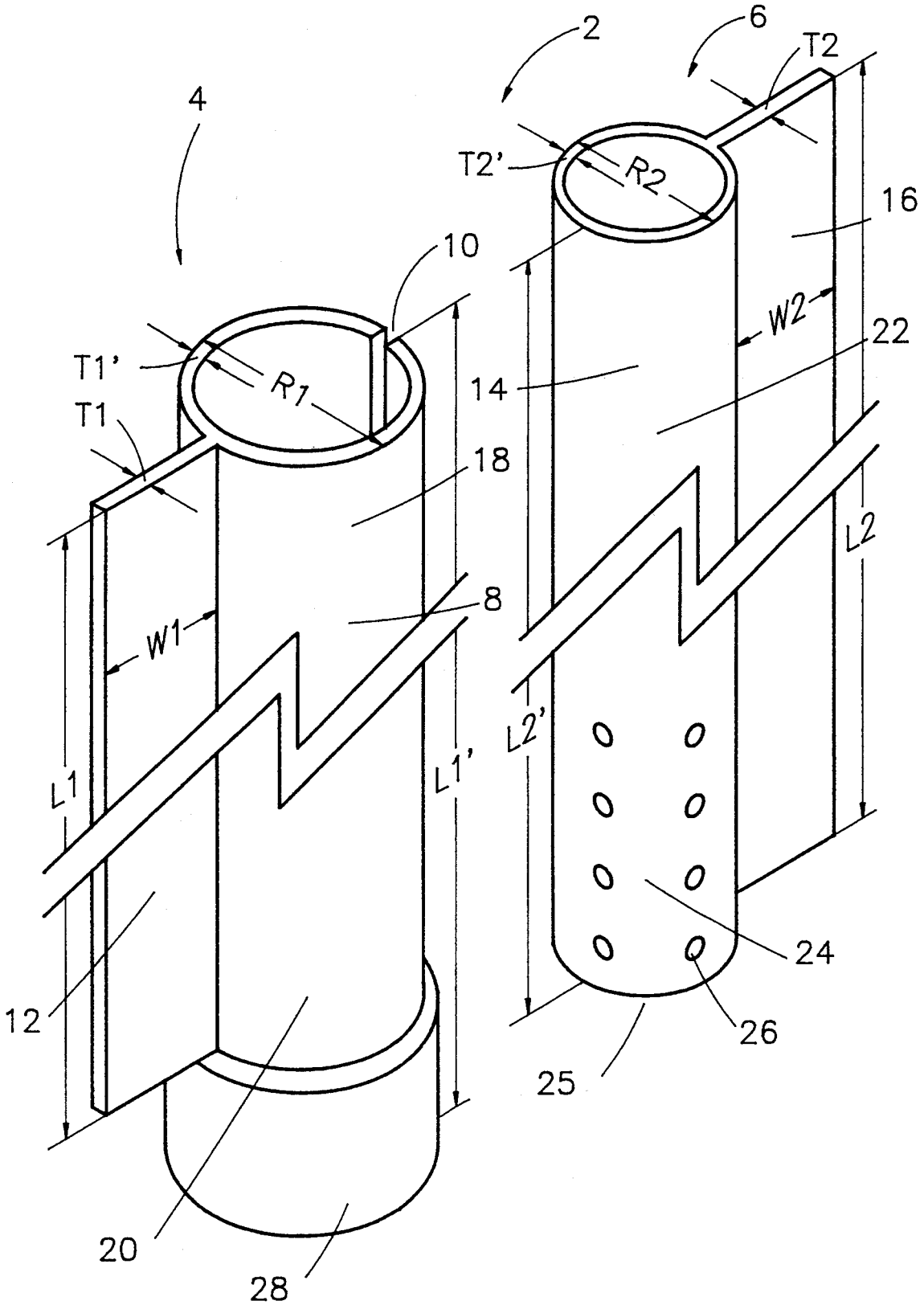
FIG. 1 shows schematically the outer portion and the inner portion of a connector for plastic sheets according to a preferred embodiment of the present invention.

With regard to the connector 2, as better illustrated in FIG. 1, there is provided an outer portion 4 and an inner portion 6.

The outer portion 4 comprises a first tube 8 having a first upper end 18, a first lower end 20, a tube slot 10 lengthwise, and a first flap 12 disposed in a diametrically opposite position with respect to the tube slot 10 and directed away from the tube slot 10. The flap 12 has a width W1, a thickness T1, and a length L1, while the first tube 8 has an outside diameter R1, a wall thickness T1' and a length L1'. The first portion 4, also comprises a cap 28 to cover the first lower end 20 of the first tube 8. Although the cap 28 is not absolutely necessary in a number of occasions, it is critical for optimal performance in all occasions.

The inner portion 6 comprises a second tube 14 having a second flap 16. The second flap 16 has a width W2, a thickness T2, and a length L2. The second tube 14 has a second upper end 22, a second lower end 24, an outside diameter R2, a wall thickness T2', and perforations 26 at the second lower end 24. Although the perforations 26 are not absolutely necessary in a number of occasions, their presence is critical for optimal performance in all occasions.

Figure 2:
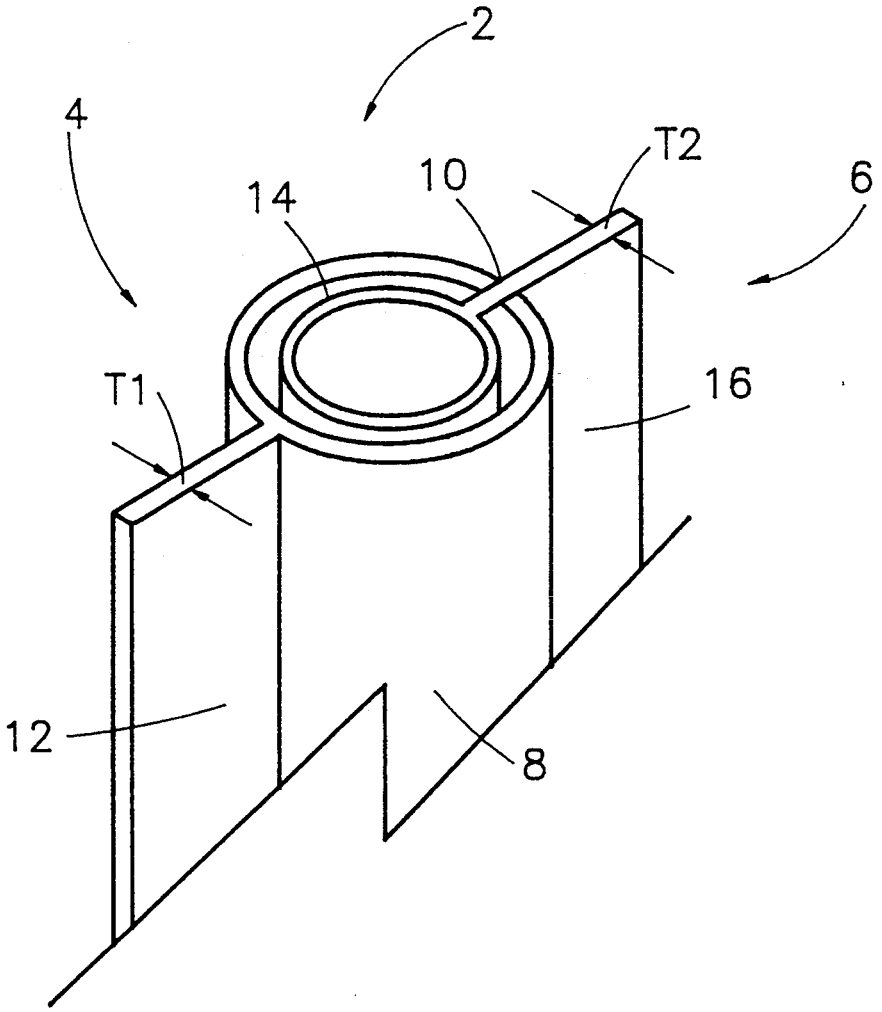
FIG. 2 shows a fragmental view of the connector of the embodiment of FIG. 1 in an assembled form.

The connector 2, in an assembled version, is better shown in FIG. 2. In the assembled version, the second tube 14 is positioned within the first tube 8 in a manner that the second flap 16 extends through the tube slot 10 in a direction away from the first flap 12. Although the width of the tube slot 10 should preferably be ±50% of the thickness T2 of the second flap 16, it is critical for optimal performance that it is 10 to 50% smaller than the thickness of the second flap 16, as it will be better described later.

The length L1 of the first flap 12 may be somewhat smaller than the length L1' of the first tube 8, in a manner to accommodate the cap 28 at the lower end 20 of the first tube 8. Alternatively, the cap 28 may have a first cap slot (not shown) in a manner to allow the first flap to pass through, thus not hindering the insertion of the cap 28 over the first lower end 20. In this alternative case the length L1 of the first flap 12 may be substantially the same as the length L1' of the first tube 8. Similarly, length L2 of the second flap 16 may be somewhat smaller than the length L1' of the first tube 8, so that in an assembled configuration of the connector 2, it may accommodate the cap 28 at the lower end 20 of the first tube 8. Alternatively, the cap 28 may also have a second cap slot (not shown) in a manner to allow the second flap to pass through, thus not hindering the insertion of the cap 28 over the first lower end 20. In this alternative case the length L2 of the second flap 16 may be substantially the same as the length L1' of the first tube 8. The length L2' of the second tube 14 should be about the same or slightly smaller than the length L1' of the first tube 8.

Although the dimensions of the elements of two portion 4 and 6 may vary widely, depending on the particular circumstances, nominal dimensions in an average case would be as follows.

R1: about 2"
R2: about 1"
T1, T1', T2, T2': about 0.080" to 0.120"
W1, W2 : about 6" to 10"
L1, L2 : about 10 to 40 feet Preferably, the perforations 26 have a diameter of about ⅛", they extend 1–4 feet at the second lower end 24, and their frequency is 20–30 per linear foot, equidistantly spaced.

As shown In FIG. 2, it is preferable that the first tube 8 and the second tube 14 are substantially concentric in the assembled configuration of the connector 2. In order to ensure this, in a different embodiment of this invention, the second flap 16 has two grooves (not shown) disposed lengthwise on the two sides of the flap, commensurate to the slot 10, and at such distance from the second tube so that when the slot 10 snugly slides within said grooves, the second tube 14 is forced to take a substantially concentric position with respect to the first tube 8. An additional advantage of this configuration is better isolation characteristics of the connector.

It is essential that the material of construction is resistant to the underground conditions it is going to be subjected, as described in more details at a later stage. It is preferable that the material used to construct the connector is also extrudable so that each portion of the connector may be manufactured in an economical, continuous, easy process. Under these circumstances, the flaps 12 and 16 are integral parts of the respective tubes 8 and 10, respectively. Further it is also preferable that the construction material is heat weldable so that the plastic sheets which will form a secondary barrier may be easily attached to the flaps of the connector by a welding process. Thus the plastic sheets themselves are preferably weldable. Although extrusion welding may be used, fusion welding is highly preferred according to this invention. High density polyethylene is the construction material of preference, since it combines economy with barrier and other physical characteristics required by this application, as described hereinwith.

The connector 2 is operated in a manner explained at a later portion of this description.

Figure 3:
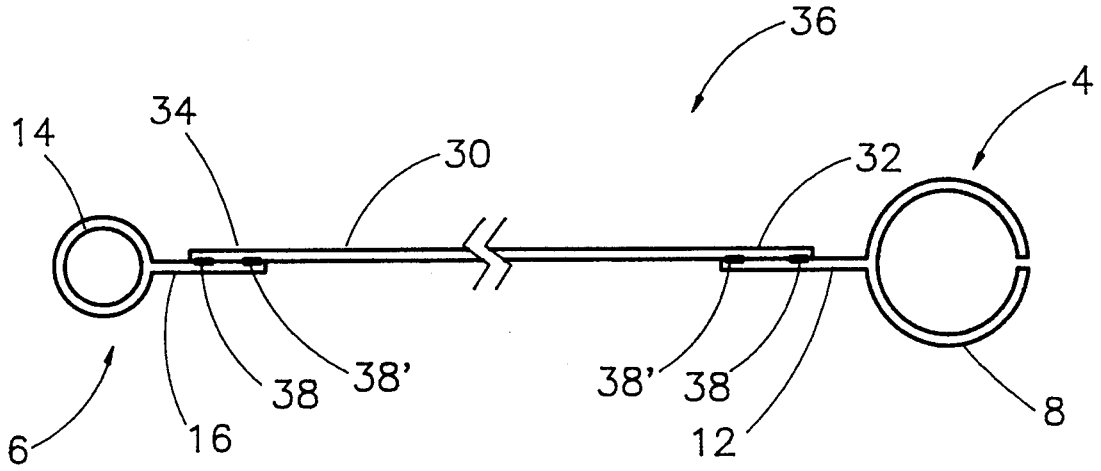
FIG. 3 shows schematically a cross-sectional view of a modular panel, wherein a plastic sheet has the inner portion of the connector attached at one edge and the outer portion attached to the other edge.

As better shown in FIG. 3, the first edge 32 and the second edge 34 of a suitable plastic sheet 30 are connected to the flaps 12 and 16 of the first and second portions 4 and 6 of the connector 2, in order to form a modular panel 36. The plastic sheet and the first and second portions 4 and 6 of the connector are preferably made of a plastic material, more preferably by an extrudable and/or weldable material, which even more preferably comprises high density polyethylene. The thickness of the plastic sheet is preferably within the range of 0.080" to 0.120". The connection of the edges of the panel to the flaps is preferably made by fuse welding, and more preferably in more than one weld strip lines 38 and 38' as illustrated in FIG. 3. The distance between edge to edge is preferably in the range of 6 to 8 feet.

A successive modular panel 36', similar to the panel 36, may be connected to modular panel 36 by inserting the second tube 14' of panel 36' to the first tube 8 of panel 36. Preferably the insertion is made in a manner that the second tube 14' and the first tube 8 are as close to being concentric as possible. Interconnecting successive panels in the same manner, a secondary barrier 37 is formed.

Figure 5:
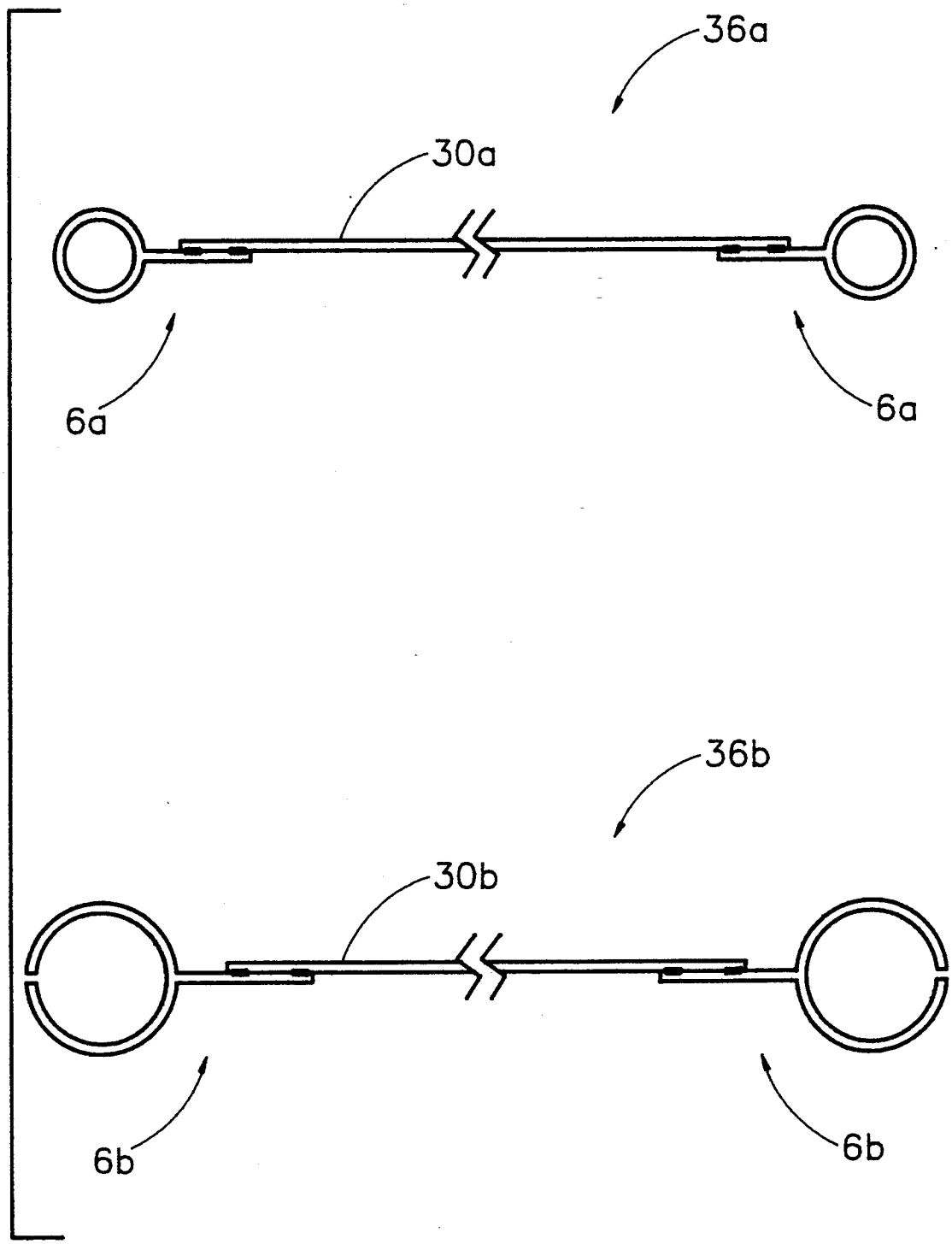
FIG. 5 shows schematically a different arrangement of modular panels according to another embodiment of the present invention.

Although the preferred configuration of modular panels and the preferred way of interconnecting them is the one described above, it is possible to use the configuration shown in FIG. 5. According to this configuration, a first set of modular panels **36*a* comprise a plastic sheet connected to the flaps of two substantially identical second portions of connector 2, while a second set of modular panels 36*b* comprise a plastic sheet connected to the flaps of two substantially identical first portions 6*b* of connector 2**. In order to interconnect the modular panels, the two types are used in an alternating manner, and they are connected as described above.

In order to improve the secondary barrier 37 characteristics and prevent any leakage though the connectors, it is very important to introduce a sealer at least in space 40 (FIG. 4) between the first tube 8 and the second tube 14'. The sealer may also be present in space 42 within the second tube 14'. The operation of introducing the sealer according to the present invention will be described at a later point.

It should be understood that the connectors used to make the modular panels and the secondary barrier may have all the characteristics detailed in the description of the connectors hereinabove.

Figure 6:
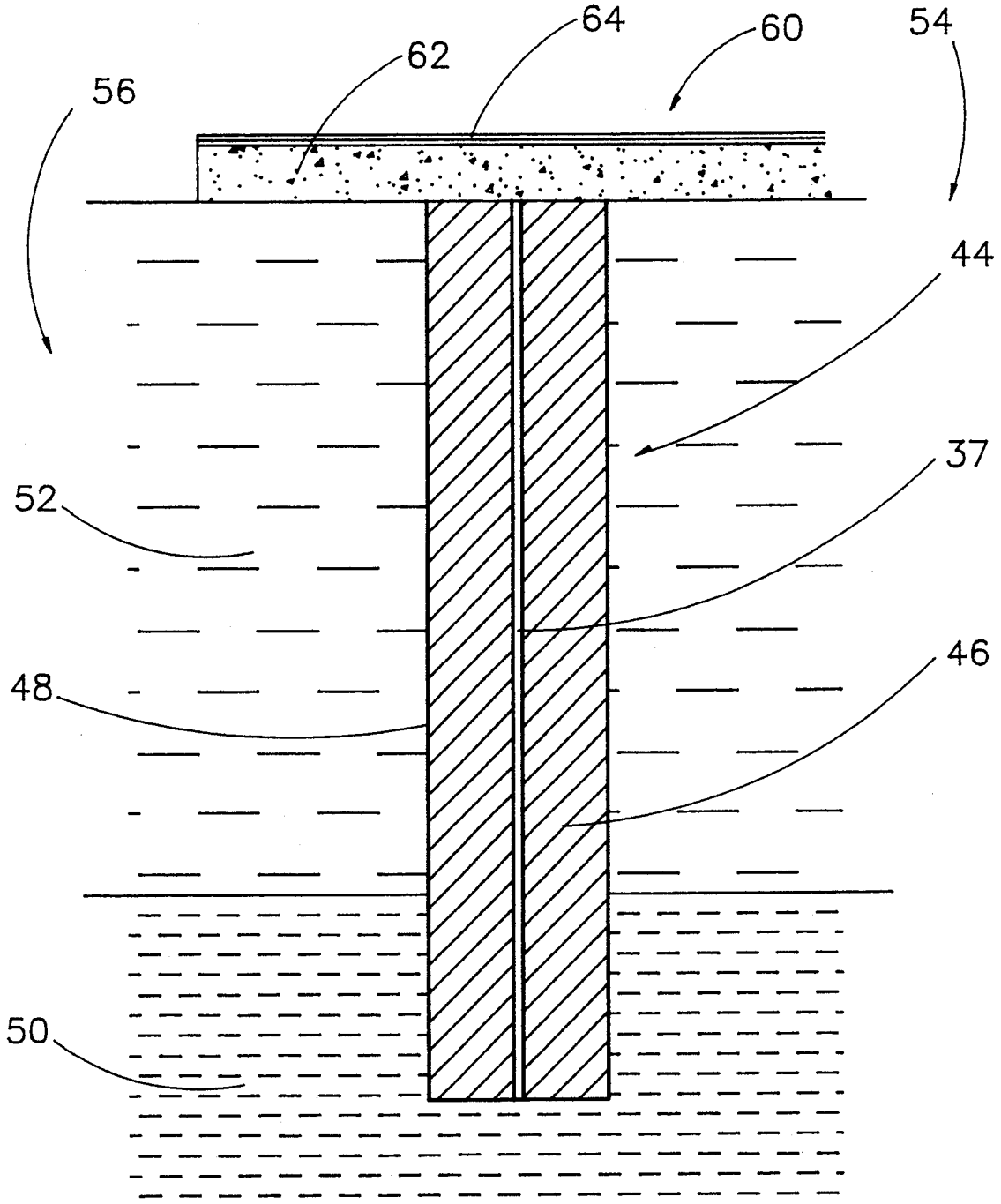
FIG. 6 shows schematically the cross-section of a cutoff wall.

According to the instant invention, a cutoff wall 44, as illustrated schematically in FIG. 6, comprises a primary barrier 46, and a secondary barrier 37 embedded within the primary barrier 46. The characteristics of the secondary barrier 37 have already been discussed. The primary barrier 44 comprises dense soil introduced in a trench 48 in the form of a wall. By dense soil it is meant soil which has been reinforced by an additive, which considerably reduces the porosity of the soil in a manner to make it highly resistant to water penetration. Such additives include but are not limited to cement, gypsum, bentonite, mixtures thereof, and the like. Bentonite is the preferred choice presently, because of the low cost combined with its effectiveness. A nominal amount of bentonite used with clay and other soil is about 3–6%.

The role of the secondary barrier 37 is to isolate and prevent completely, for all practical purposes, the passage of contaminants, usually carried and transferred by water, from a contaminated area 54 to the environment 56.

Figure 7:
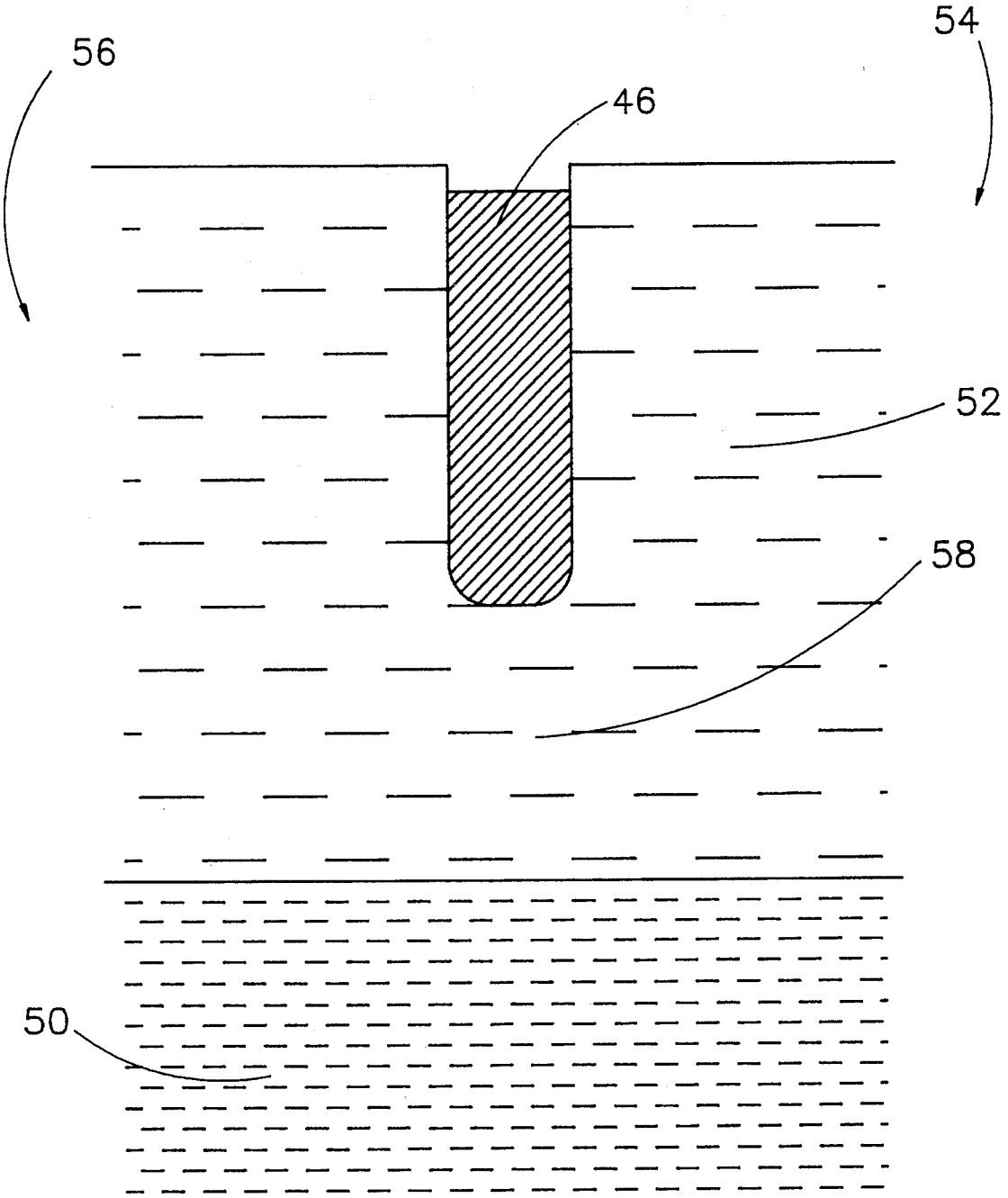
FIG. 7 shows schematically a primary barrier at an intermediate stage of its formation.

The depth of the trench and the wall greatly depends on the condition of the contaminated soil. For effective isolation, the depth of the cutoff wall has to reach and penetrate a stratum of naturally occurring dense soil 50. Penetration of at least two feet is desirable. If the wall stops within the loose soil stratum 52, contaminants may escape from a region 58 between the bottom of the wall and the dense soil stratum 50, as better shown in FIG. 7.

For additional protection, a hard cover 60 may be placed over the contaminated area 54 and the cutoff wall 44. The hard cover 60 has preferably a bottom layer 62 of cement stabilized gypsum (calcium sulfate), and an upper layer 64 of asphalt.

Figure 8:
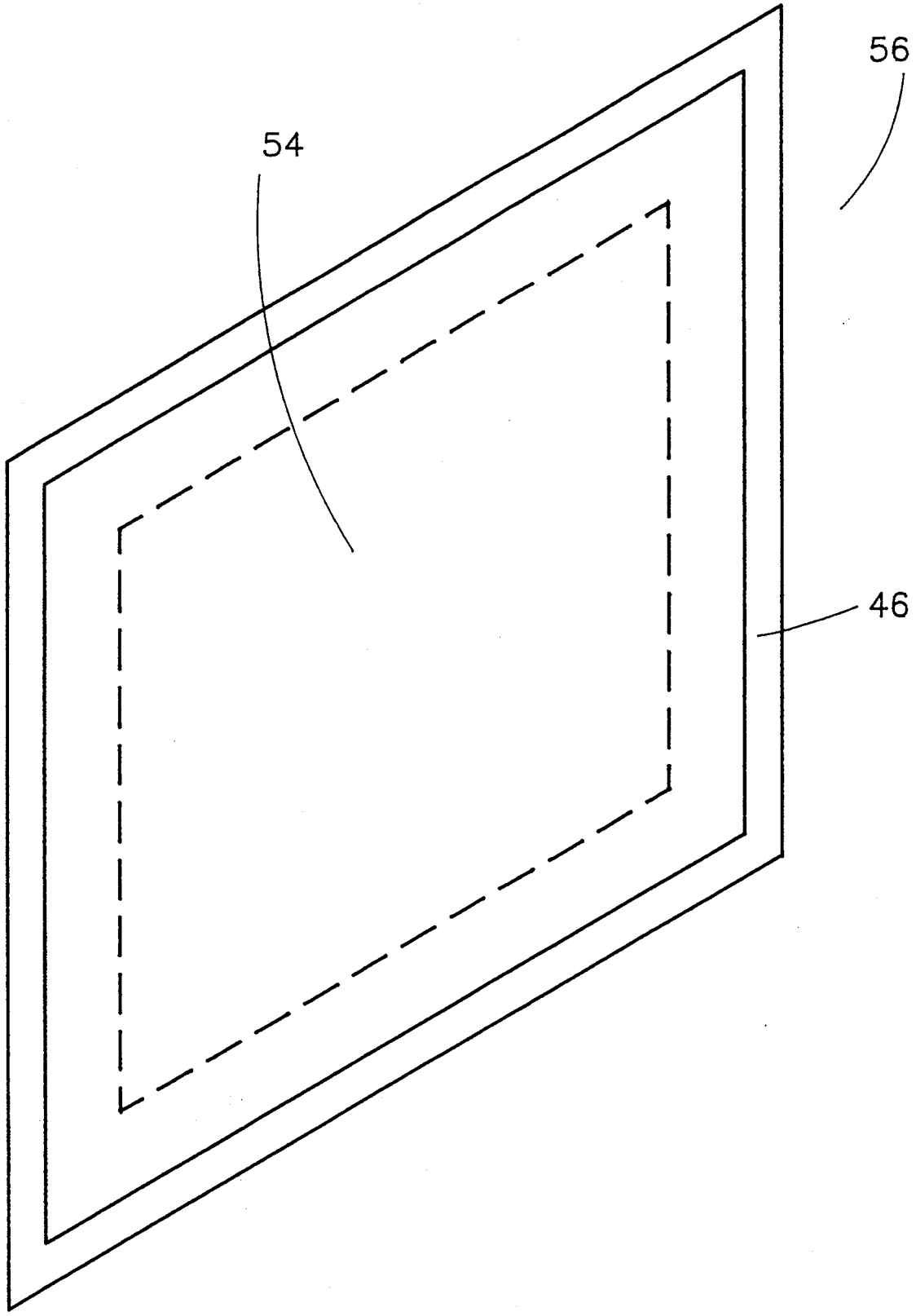
FIG. 8 shows schematically a contaminated soil area fully surrounded by a cutoff wall

The cutoff wall 46 may surround completely the contaminated area 54 in order to isolate it from the environment 56, as better shown in FIG. 8. A hard cover, as shown in FIG. 6, preferably covers the whole contaminated area, and extends somewhat further than the boundary of the surrounding cutoff wall.

Figure 9:
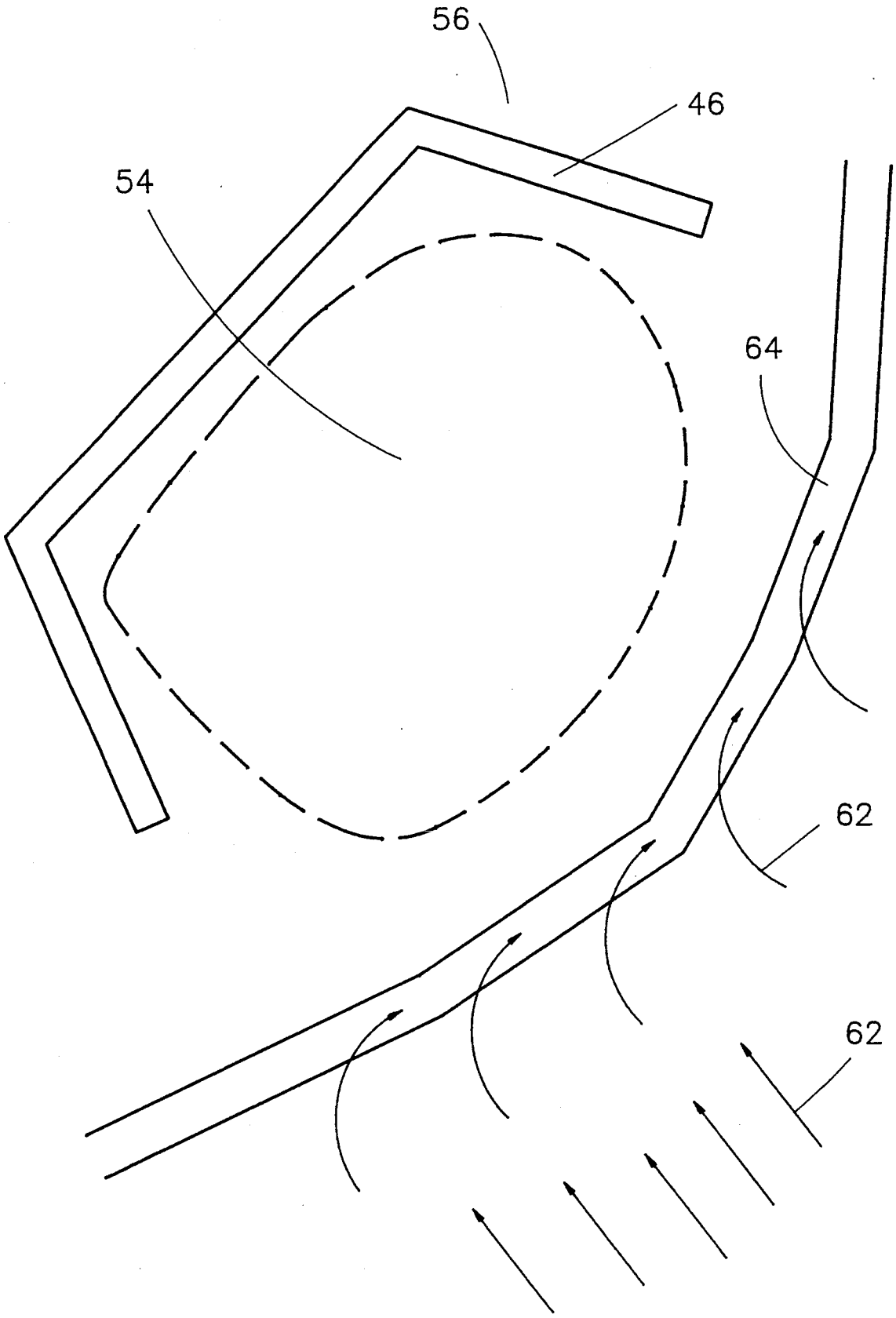
FIG. 9 shows schematically a contaminated soil area partially surrounded by a cutoff wall and isolated from incoming water by a french drain.

An alternative way to isolate the contaminated area 54 from the environment 56, in the case of underground water flowing in a direction indicated, for example, by the arrows 62 in FIG. 9, is to form a french-drain 64, substantially perpendicular to the water flow, in order to intercept the water flow and redirect it away from the contaminated area. French-drains are trenches containing gravel, and they are very well known to the art. They may be designed easily taking into account the amount of water to be removed in a worst case situation, the inclination of the ground, and other conventional parameters well known to the artisans. In this case, the cutoff wall does not have to completely surround the contaminated area. A configuration as the one shown in FIG. 9 is an example of a viable system to isolate the contaminated area 54 from the environment 56. A hard cover, as before, should preferably cover the contaminated area, and have boundaries extending from the partially surrounding cutoff wall to the french-drain.

The method of constructing and the operation of a cutoff wall, as well as of its components, is exemplified and explained in detail hereinbelow.

Initially, an excavator starts digging along a predetermined location around a contaminated area 54 in order to form a trench 48. The width of the trench is usually 2–3 feet, but depending on the circumstances, wider or narrower widths may be desirable. After the depth of the trench has reached a few feet, soil mixed with bentonite and water is pumped into the trench in order to prevent collapsing of the walls. An intermediate stage of excavation and pumping in soil mixture may be represented in FIG. 7. The excavation continues with simultaneous pumping of the above soil mixture until an appropriate depth has been reached. This depth is determined, as aforementioned, by the depth at which a stratum of naturally occurring dense soil 50 exists.

This operation completes the initial stage of formation of the primary barrier. Examples of trench shapes correspond to the shapes of cutoff walls shown in FIGS. 8 and 9.

After the appropriate depth has been reached by penetrating the stratum of dense soil 50, and the densifying additive in the soil is bentonite, an operator has nominally 24 to 36 hours to introduce a secondary barrier, before the mixture of the primary barrier hardens and densifies. Thus, the formation of the secondary barrier starts preferably immediately by inserting and interconnecting modular panels 36 into the "green" primary barrier, one after the other, until the secondary barrier is completed. By the term "green" denotes the condition before hardening, densifying, curing, and the like.

To perform this task, a steel plate 66 (FIGS. 10*a* to 10*c*), commensurate in size with a modular panel 36 (FIGS. 3 and 11) may be used.

In one embodiment of this invention, the steel plate is about ¾" thick, reinforced with 4" I-beams or flanges. The steel plate 66 has a plurality of dowels 70 of about ¾" in diameter at its lower end, and lifting holes 72 at its upper end. On both sides it has pipe brackets 74, commensurate to the size of the two connector portions 4 and 6.

Figure 11:
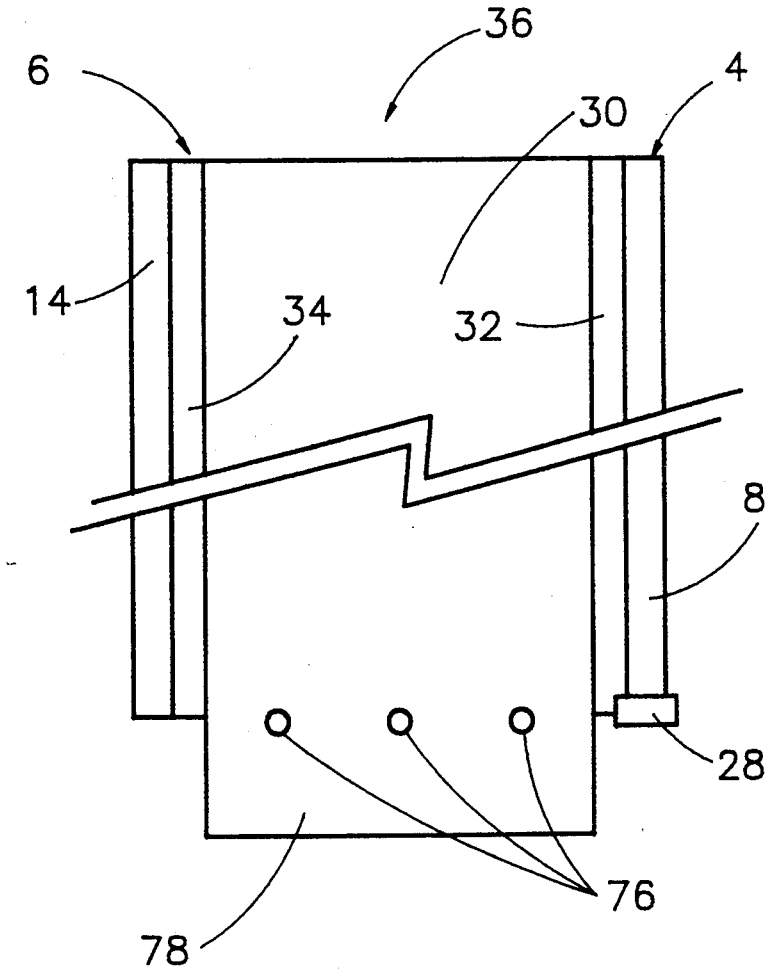
FIG. 11 shows schematically the front view of a modular panel before being attached to the steel plate of FIG. 10*a*.
Figure 12:
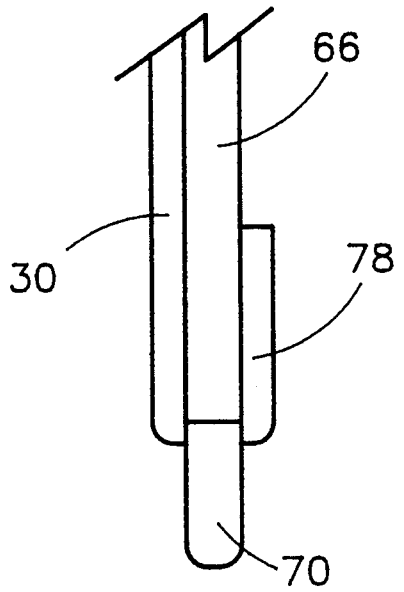
FIG. 12 shows schematically the folding of the plastic sheet of the modular panel of FIG. 11 around the lower pard of the steel plate.

The modular panel 36, better shown in FIG. 11, may be assembled in the field by fusion welding the inner portion 6 and the outer portion 4 of the connector 2 to the edges 34 and 32 of the plastic sheet 30, respectively. The plastic sheet 30 is also perforated to form a plurality of holes 76 at its lower part 78, commensurate in size and position with the dowels 70 of the plate 66. The dowels 70 are passed through the holes 76, and the lower part 78 of the plastic sheet 30 is folded to the back of the steel plate 66, as better shown in FIG. 12. The rest of the plastic sheet is placed in front of the plate 66. The first tube 8 and second tube 14 are allowed to nest in the pipe brackets 74.

In sequence, the steel plate 66 with the modular panel 36 attached to it, is lifted by a crane and dipped into the "green" primary barrier. Some vibratory and/or pushing motion is helpful to facilitate the insertion process. The steel plate 66 is then pulled back leaving the modular panel 36 embedded in the "green" primary barrier. It is preferable that the modular panel 36, and finally the whole secondary barrier 37, are centered with respect to the primary barrier 46, as better shown in FIG. 6.

Figure 4:
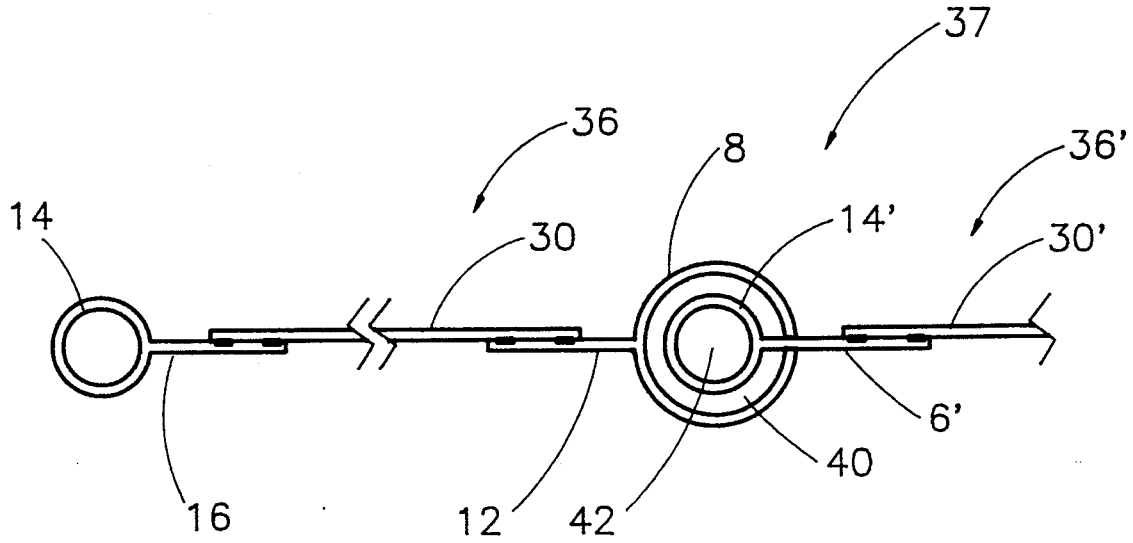
FIG. 4 shows schematically two modular panels connected with the connector of the present invention.

Following this operation, another modular panel 36' is attached to the steel plate 66, and inserted into the green primary barrier 46 in a manner better illustrated in FIG. 4, wherein the inner tube 14' of the new panel 36' is inserted to the outer tube 8 of the previous modular panel 36. The same procedure is followed until the whole length of the length of the primary barrier is finished. Following, or concurrently with the task of interconnecting modular panels as described above, a critical operation has to be performed; that of sealing each connector so that no leakage of contaminants may occur.

This critical operation according to the present invention, may take place in one, but preferably it should take place in two steps. In the first step a cleaning fluid, such as water or air for example is forced trough each inner tube 14. The cleaning fluid passes through the length of the inner tube 14, passes through the perforations 26 and/or through the open lower end 25 (FIG. 1), and then travels all the way up in the space between the second tube 14 and the first tube 8, displacing all "green" primer barrier matter present in that space. In the second step a sealer, such as for example bentonite grout, other suitable grout, expansion cement, and the like, is forced through the same path, by pumping for example, thus filling and sealing the connector cavities. As aforementioned, the one step process would involve introduction of the sealer which would displace unwanted matter, without the need for the first cleaning step. The two step process, however, is preferable because it provides better sealing.

A hard cover 60 (FIG. 6) may then be added at the top of the contaminated soil, and extend to the boundaries, or somewhat further, the boundaries including, but not limited to cutoff walls and french drains.

As aforementioned, in a different, less preferred embodiment, the modular panels may be in two different sets as shown in FIG. 5. In one set both edges of the plastic sheet are attached to an inner portion of the connector, while in the other set both ends are attached to the outer portion of the connector. In such a case the panels should be inserted in alternating order from the two sets.

It may easily be seen now by the reader that the special combination of the tubular connectors disclosed hereinwith, presents critical and unique features that cannot be found in systems of the prior art. Ease of connecting the inner and outer tubular portions combined with the ease and quality of sealing, are believed by Applicant to be considerable contributions, highly advancing the art.

What is claimed is:

1. A connector for plastic sheet comprising an outer portion and an inner portion, the outer portion comprising a first tube having a tube slot lengthwise, the slot having a slot-width, and a first flap disposed in a diametrically opposite position with respect to the tube slot and directed away from the tube slot, the first tube also having a first upper end and a first lower end;

the inner portion comprising a second tube having a second flap, the second flap having a thickness, the second tube adapted to fit within the first tube in a manner that the second flap extends through the tube slot in a direction away from the first flap, the second tube also having a second upper end and a second lower end; and the slot-width being 10–50% smaller than the thickness of the second flap.

2. A connector as defined in claim 1, further comprising a sealer substantially surrounding the second tube and disposed between the first tube and the second tube.

3. A connector as defined in claim 2, wherein the second lower end has perforations.

4. A connector as defined in claim 2, wherein the first tube further comprises a cap fitted around the first lower end.

5. A connector as defined in claim 1, wherein the first tube further comprises a cap fitted around the first lower end.

6. A connector as defined in claim 1, wherein the second lower end has perforations.

7. A connector as defined in claim 1, wherein the first tube further comprises a cap fitted around the first lower end.

8. A connector as defined in claim 1, wherein the connector is made of plastic material, which is extrudable and heat weldable.

9. A connector as defined in claim 8, wherein the first and second flaps are integral parts of the respective tubes.

10. A connector as defined in claim 8, wherein the plastic material comprises High Density Polyethylene.

11. A secondary barrier comprising a plurality of interconnected panels, each panel comprising a plastic sheet having a first edge and a second edge, each plastic sheet attached to a successive plastic sheet by means of connectors, each connector comprising an outer portion and an inner portion, the outer portion comprising a first tube having a tube slot lengthwise, the slot having a slot-width, and a first flap disposed in a diametrically opposite position with respect to the tube slot and directed away from the tube slot, the first tube also having a first upper end and a first lower end;

the inner portion comprising a second tube having a second flap, the second flap having a thickness, the second tube adapted to fit within the first tube in a manner that the second flap extends through the tube slot in a direction away from the first flap, the second tube also having a second upper end and a second lower end; and the slot-width being 10–50% smaller than the thickness of the second flap.

12. A secondary barrier as defined in claim 11, wherein the first edge of each plastic sheet is connected to the first flap of one connector and the second edge is connected to the second flap of another connector.

13. A secondary barrier as defined in claim 11, wherein both edges of a first set of plastic sheets are connected to the first flap of a set of connectors forming a first set of panels, and both edges of a second set of plastic sheets are connected to the second flap of a second set of connectors forming a second set of panels, the panels interconnected in a manner that panels corresponding to the first set alternate with panels corresponding to the second set.

14. A secondary barrier as defined in claim 11, further comprising a sealer substantially surrounding the second tube and disposed between the first tube and the second tube.

15. A secondary barrier as defined in claim 14, wherein the second lower end has perforations.

16. A secondary barrier as defined in claim 14, wherein the first tube further comprises a cap fitted around the first lower end.

17. A secondary barrier as defined in claim 11, wherein the first tube further comprises a cap fitted around the first lower end.

18. A secondary barrier as defined in claim 11, wherein the second lower end has perforations.

19. A secondary barrier as defined in claim 11, wherein the first tube further comprises a cap fitted around the first lower end.

20. A secondary barrier as defined in claim 11, wherein the connector is made of plastic material, which is extrudable and heat weldable.

21. A secondary barrier as defined in claim 20, wherein the first and second flaps are integral parts of the respective tubes.

22. A secondary barrier as defined in claim 21, wherein the plastic material comprises High Density Polyethylene.

23. A cutoff wall system comprising a primary barrier and a secondary barrier, the primary barrier being in the form of a dense soil wall the secondary barrier disposed within the primary barrier, the secondary barrier comprising a plurality of interconnected panels, each panel comprising a plastic sheet having a first edge and a second edge, each plastic sheet attached to a successive plastic sheet by means of connectors, each connector comprising an outer portion and an inner portion, the outer portion comprising a first tube having a tube slot lengthwise, the slot having a slot-width, and a first flap disposed in a diametrically opposite position with respect to the tube slot and directed away from the tube slot, the first tube also having a first upper end and a first lower end;

the inner portion comprising a second tube having a second flap, the second flap having a thickness, the second tube adapted to fit within the first tube in a manner that the second flap extends through the tube slot in a direction away from the first flap, the second tube also having a second upper end and a second lower end;

the slot-width being 10–50% smaller than the thickness of the second flap, and the attachment made so that one of the edges of one plastic sheet is connected to one of said flaps of the connector, and one of the edges of the successive sheet is connected to the remaining flap of the same connector.

24. A cutoff wall system as defined in claim 23, further comprising a hard cover on top of the cutoff system for substantially eliminating water infiltration toward said cutoff system.

25. A cutoff wall system as defined in claim 23, wherein the primary barrier comprises bentonite.

26. A cutoff wall system as defined in claim 23, wherein the first edge of each plastic sheet is connected to the first flap of one connector and the second edge is connected to the second flap of another connector.

27. A cutoff wall system as defined in claim 23, wherein both edges of a first set of plastic sheets are connected to the first flap of a set of connectors, and both edges of a second set of plastic sheets are connected to the second flap of a second set of connectors, in a manner that sheets corresponding to the first set alternate with sheets corresponding to the second set.

28. A cutoff wall system as defined in claim 23, further comprising a sealer substantially surrounding the second tube and disposed between the first tube and the second tube.

29. A cutoff wall system as defined in claim 28, wherein the second lower end has perforations.

30. A cutoff wall system as defined in claim 29, wherein the first tube further comprises a cap fitted around the first lower end.

31. A cutoff wall system as defined in claim 28, wherein the first tube further comprises a cap fitted around the first lower end.

32. A cutoff wall system as defined in claim 23, wherein the second lower end has perforations.

33. A cutoff wall system as defined in claim 23, wherein the first tube further comprises a cap fitted around the first lower end.

34. A cutoff wall system as defined in claim 23, wherein the connector is made of plastic material, which is extrudable and heat weldable.

35. A connector as defined in claim 34, wherein the first and second flaps are integral parts of the respective tubes.

36. A cutoff wall system as defined in claim 35, wherein the plastic material and the plastic sheet comprise High Density Polyethylene, and the dense soil comprises bentonite.

37. A method of forming a cutoff wall comprising the steps of forming a trench filling the trench with dense soil to form a primary barrier;

inserting an initial panel within the primary barrier, the panel comprising a plastic sheet having a first edge and a second edge, and a connector comprising an outer portion and an inner portion the outer portion comprising a first tube having a tube slot lengthwise, the slot having a slot-width, and a first flap disposed in a diametrically opposite position with respect to the tube slot and directed away from the tube slot, the first tube also having a first upper end and a first lower end;

the inner portion comprising a second tube having a second flap, the second flap having a thickness, the second tube adapted to fit within the first tube in a manner that the second flap extends through the tube slot in a direction away from the first flap, the second tube also having a second upper end and a second lower end;

the slot-width being 10–50% smaller than the thickness of the second flap, and the attachment made so that one of the edges of one plastic sheet is connected to one of said flaps of the connector, and one of the edges of the successive sheet is connected to the remaining flap of the same connector;

inserting a successive panel within the primary barrier, the successive panel being substantially identical to the initial panel, in a manner that the second tube of the successive panel is inserted into the first tube of the initial panel; and inserting more panels within the primary barrier, each panel being interconnected to a successive one in a similar manner until a desired number of interconnected panels have formed a secondary barrier, thus completing the cutoff wall.

38. A method as defined in claim 37, wherein each panel of the secondary barrier is inserted with the help of a metal plate, to which said panel is temporarily attached.

39. A method as defined in claim 37, wherein the successive panels are substantially made of plastic material.

40. A method as defined in claim 39, wherein the plastic material comprises high density polyethylene.

41. A method as defined in claim 37, wherein the first tube further comprises a cap fitted around the first lower end.

42. A method as defined in claim 41, further comprising the step of inserting sealer through the second tube in order to fill the space between the first and the second tubes.

43. A method as defined in claim 42, further comprising the step of blowing a fluid through the second tube, which fluid also passes through the space between the first and the second tube, before inserting sealer, in order to clean said second tube and said space.

44. A method as defined in claim 41, wherein the second lower end has perforations.

45. A method as defined in claim 44, further comprising the step of inserting sealer through the second tube in order to fill the space between the first and the second tubes.

46. A method of forming a cutoff wall comprising the steps of forming a trench filling the trench with dense soil to form a primary barrier;

inserting an initial panel within the primary barrier, the panel comprising a plastic sheet having a first edge and a second edge, and a connector comprising an outer portion, an inner portion, and a cup, the outer portion comprising a first tube having a tube slot lengthwise, and a first flap disposed in a diametrically opposite position with respect to the tube slot and directed away from the tube slot, the first tube also having a first upper end and a first lower end;

the inner portion comprising a second tube having a second flap, the second tube adapted to fit within the first tube in a manner that the second flap extends through the tube slot in a direction away from the first flap, the second tube also having a second upper end and a second lower end, the cup fitted around the first lower end; and the attachment of the plastic sheet to the connector made so that the first edge of the plastic sheet is connected to the first flap and the second edge is connected to the second flap of the connector;

inserting a successive panel within the primary barrier, the successive panel being substantially identical to the initial panel, in a manner that the second tube of the successive panel is inserted into the first tube of the initial panel;

inserting more panels within the primary barrier, each panel being interconnected to a successive one in a similar manner until a desired number of interconnected panels have formed a secondary barrier;

blowing a fluid through the second tube, which fluid also passes through the space between the first and the second tube, in order to clean said second tube and said space;

inserting sealer through the second tube in order to fill the space between the first and the second tubes.

47. A method as defined in claim 46, wherein the second lower end has perforations.

* * * * *